US005544628A

United States Patent [19]

Voigt

[11] Patent Number: 5,544,628

[45] Date of Patent: Aug. 13, 1996

[54] VALVE CONTROL ARRANGEMENT FOR AN INTERNAL COMBUSTION ENGINE

[75] Inventor: Dieter Voigt, Wolfsburg, Germany

[73] Assignee: Volkswagen AG, Wolfsburg, Germany

[21] Appl. No.: 461,719

[22] Filed: Jun. 5, 1995

[30] Foreign Application Priority Data

Jul. 6, 1994 [DE] Germany ..... 44 23 606.9

[51] Int. Cl.[6] ..... F01L 1/12; F02D 13/06

[52] U.S. Cl. ..... 123/90.16; 123/90.39; 123/198 F

[58] Field of Search ..... 123/90.15, 90.16, 123/90.27, 90.39, 90.41, 90.42, 90.43, 90.44, 90.45, 90.46, 90.48, 90.49, 90.5, 90.65, 90.67, 198 F

[56] References Cited

U.S. PATENT DOCUMENTS

| | | | |
|---|---|---|---|
| 4,200,081 | 4/1980 | Meyer et al. | 123/90.16 |
| 4,284,042 | 8/1981 | Springer | 123/90.16 |
| 4,611,558 | 9/1986 | Yoshizaki et al. | 123/90.16 |
| 4,612,887 | 9/1986 | Yoshizaki | 123/90.16 |
| 4,615,307 | 10/1986 | Kodama et al. | 123/90.16 |
| 4,768,467 | 9/1988 | Yamada et al. | 123/90.16 |
| 4,770,137 | 9/1988 | Okabe et al. | 123/198 F |
| 5,402,756 | 4/1995 | Bohme et al. | 123/90.16 |

FOREIGN PATENT DOCUMENTS

WO93/18284 9/1993 WIPO .

*Primary Examiner*—Weilun Lo

*Attorney, Agent, or Firm*—Brumbaugh, Graves, Donohue & Raymond

[57] ABSTRACT

An arrangement for controlling a deactivatable valve in an internal combustion engine includes a locking member which is displaceable between valve-locking and valve-release positions in a coupling element consisting of a rocker arm connecting the camshaft with the valve. In the deactivated state, the rocker arm is movable with respect to the valve and the valve return spring acts as a restoring spring acting through a spring plate which is displaceable relative to the valve.

14 Claims, 2 Drawing Sheets

VALVE CONTROL ARRANGEMENT FOR AN INTERNAL COMBUSTION ENGINE

BACKGROUND OF THE INVENTION

This invention relates to valve control arrangements for internal combustion engines having a valve capable of deactivation.

PCT International Application No. WO 93/18284 discloses a valve control arrangement in which a cup tappet constitutes a coupling element between a camshaft and an intake or exhaust valve in a cylinder head which is capable of deactivation. In that arrangement, pistons which are radially displaceable by hydraulic pressure act as locking elements. The pistons are arranged so that, in a first position which causes the valve to be activated, they connect the valve in locked relation to the tappet and, in a second position in which the valve is deactivated, they permit relative displacement of the tappet with respect to the valve to provide an idle tappet stroke. To assure that the tappet remains in contact with the camshaft when the valve is deactivated, a spring is provided between the spring plate and the tappet in addition to the conventional valve-closing spring which acts on a spring plate affixed to the end of the valve stem.

SUMMARY OF THE INVENTION

Accordingly, it is an object of the present invention to provide a valve control arrangement for a deactivated valve which overcomes the disadvantages of the prior art.

Another object of the invention is to provide a valve control arrangement for a deactivatable valve in which the number of structural parts is reduced.

These and other objects of the invention are attained by providing a deactivatable valve control arrangement including a coupling element between a valve and a camshaft in which the valve-closing spring retains the coupling element in contact with the camshaft when the valve is deactivated.

In a preferred embodiment of a deactivatable valve control arrangement, the valve-closing spring engages a spring plate which is displaceable with respect to the valve and bears on the coupling element so that the coupling element remains in constant contact with the camshaft, thereby avoiding the necessity for the separate second spring used in the conventional arrangement.

The invention takes advantage of the fact that the valve has relatively great inertial mass. In the deactivated state, the coupling element moves along the valve stem end at full cam lift, the valve-closing spring being compressed in accordance with the cam lift, while the valve remains in its closed position because of its inertia. Retention of the valve in the closed position is assisted by friction between the valve stem guide and the valve stem seal.

In an advantageous embodiment, the coupling element includes a chamber having an opening which receives the end of the valve stem in which a locking element is displaceable by a pressure medium between a first position activating the valve, and a second position deactivating the valve. To assure that the spring plate is movable on the valve stem, the valve stem includes a longitudinal section having reduced diameter on which the spring plate is received with little radial play. The axial length of the reduced diameter section is at least as great as the sum of the maximum valve lift and the axial dimension of the portion of the spring plate surrounding the reduced diameter section, so that the valve, when deactivated, does not open at maximum cam lift.

Alternatively, in order to avoid an accumulation of fuel in the intake duct leading to a deactivated intake valve, the axial length of the reduced diameter valve stem section may be selected so that, at maximum cam lift, the spring plate engages a shoulder on the valve stem to open the valve slightly. In order to assure immediate closure following such slight valve opening, this arrangement requires a second small-sized spring, which engages another spring plate affixed to the valve stem.

Displacement of the locking element may be effected advantageously by application of pneumatic or hydraulic pressure to the chamber from a pressure medium line within the coupling element. The pressure medium is supplied to the coupling element through a pressure medium supply line in the cylinder head in a region where there is very little relative movement between cylinder head and coupling element.

The coupling element may be designed as a rocker arm, a rocker lever, or, alternatively, as a cup tappet. In each instance, the locking element may be designed, for example, as a ball or as a piston. When the locking element is a piston, it may be preloaded in one of the two positions by a spring, for example, displacement of the locking element in the opposite direction being effected by, for example, pneumatic negative pressure.

If the coupling element is in the form of a rocker arm, one end of the lever may be supported in the cylinder head by a ball socket mounted on a hydraulic play-compensating element, while the other end of the rocker arm has a chamber with an opening which encloses at least the uppermost end of the valve stem in each position of the camshaft and thus prevents lateral displacement of the drag lever.

The valve control arrangement according to the invention advantageously may be used either in internal combustion engines with two or more intake valves per cylinder where the coupling element is capable of activating all of the intake valves, at least one of which is capable of deactivation as described above, or in internal combustion engines with only one intake valve for the purpose of cylinder disconnection.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
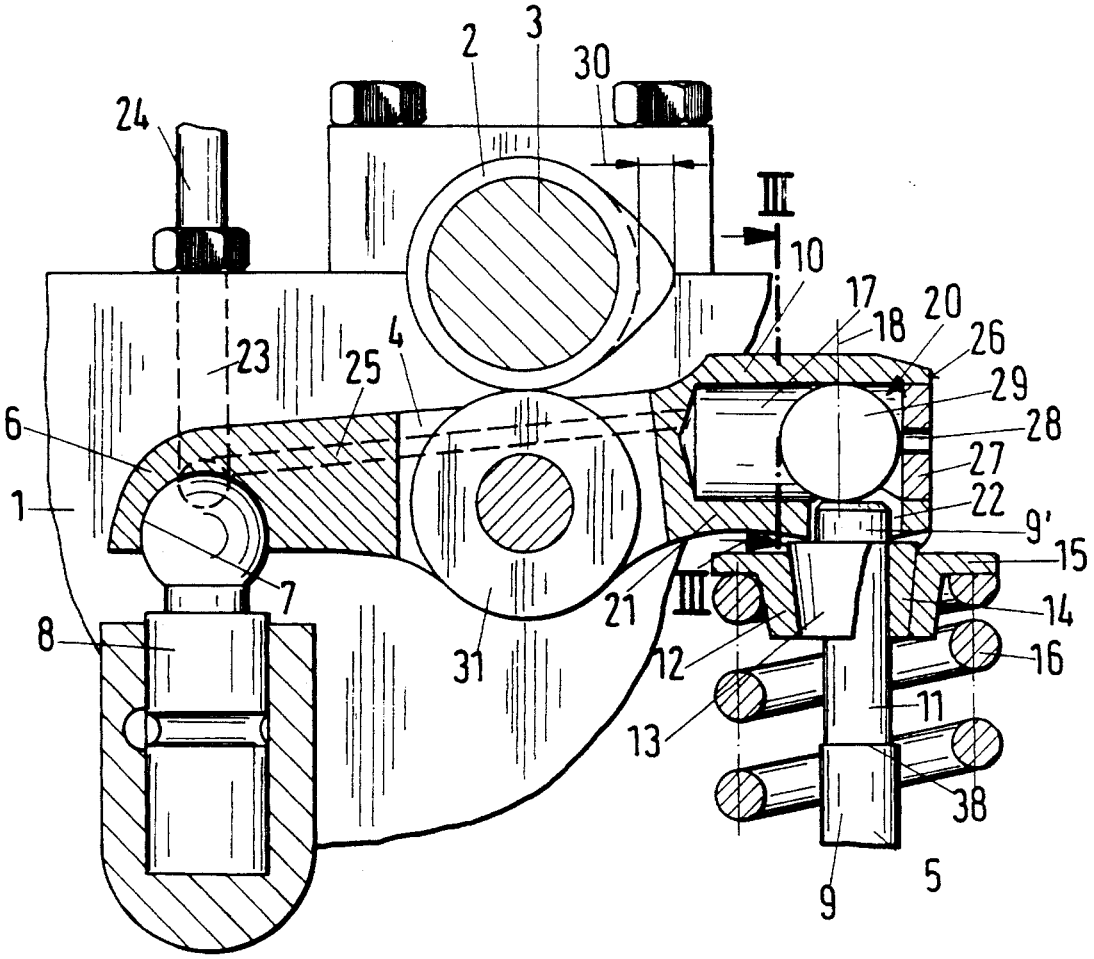
FIG. 1 is a sectional view illustrating a representative embodiment of a valve control arrangement according to the invention utilizing a roller rocker arm and showing an activated valve.

In the typical embodiment of the invention shown in FIG. 1, a cylinder head 1 of an internal combustion engine has a valve control arrangement including a cam 2 carried by a camshaft 3, a roller rocker arm 4 and an intake valve 5. The roller rocker arm 4, acting as coupling element between the camshaft 3 and the valve 5, is supported at one end 6 in the cylinder head 1 by a ball cup 7 on a hydraulic play-compensating element 8. A valve stem 9 of the valve 5 is received in the opposite end 10 of the rocker arm 4.

Figure 3:
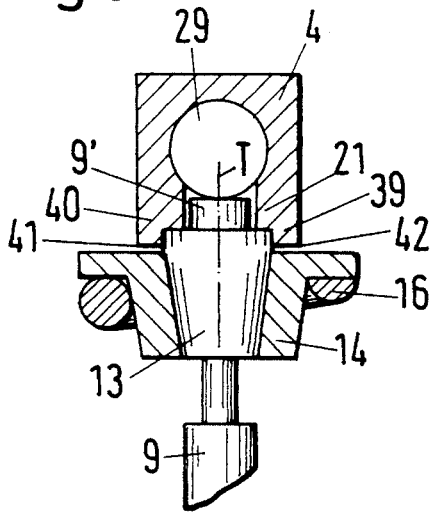
FIG. 3 is a sectional view taken along the line III—III of FIG. 1 and looking in the direction of the arrows.

The valve stem 9 is formed with a section 11 having a reduced diameter which is located inwardly in the longitudinal direction of the valve 5 from the end 9' of the valve stem. A spring plate assembly, consisting of a spring plate 12 carrying two conical pieces 13 and 14, is supported for axial motion with little radial play on the reduced diameter section 11. The pieces 13 and 14 have a semicircular shape and abut along a common parting plane T, shown in FIG. 3, which extends perpendicular to the camshaft 3. A valve-closing spring 16, which engages a collar 15 of the spring plate 12 at one end, is supported at the other end in the cylinder head 1.

The end 10 of the coupling lever 4 has a hollow cylindrical chamber accommodating a locking element 20 which is displaceable between first and second positions 18 and 19. A wall 21 of the chamber 17 adjacent to the spring plate 12 has an opening 22 with a diameter which is greater than the diameter of the valve stem end 9'.

The cylinder head 1 has a pressure medium inlet 24 connected to a bore 23 which leads to a pressure medium line 25 formed in the rocker arm 4 at the end 6 engaging the ball cup 7 where there is little relative movement between cylinder head 1 and roller rocker arm 4. The pressure medium line 25 opens into one end of the chamber 17 and the opposite end of the chamber is closed by a cover 27 which has an opening 28 to the atmosphere.

In the embodiment shown in FIG. 1, the locking element 20 is in the form of a ball 29 which is shiftable in the chamber 17 by positive or negative pneumatic pressure applied through the line 25. When the ball 29 is in the first position 18 adjacent to the cover 27 the valve 5 is activated since it is lockingly connected with the rocker arm 4. In this condition, the maximum cam lift 30 is transmitted by the cam 2 through a roller 31 to the rocker arm 4 which, supported at one end on the play-compensating element 8, moves at the opposite end 26 in the direction to open the valve.

By applying a negative pressure through the lines 23 and 25 to the chamber 17, for example from a suction pipe of the internal combustion engine, during the base circle phase of the cam 2, the ball 29 is shifted into the second position 19 at the inner end of the chamber 17. Upon subsequent further rotation of the cam 2, the end 10 of the rocker arm 4 moves downwardly with respect to the valve stem 9 during the lift 30 of the cam. Because of its inertia, the valve 5 then remains in the closed position due to the opening formed by the pieces 13 and 14 while the wall. 21 displaces the spring plate downwardly along the reduced diameter section 11 against the force of the valve-closing spring 16. In this arrangement, the axial length of the reduced diameter section 11 is selected to be slightly greater than the sum of the valve lift produced by the cam lift 30 and the axial height 32 of the spring plate assembly.

Figure 2:
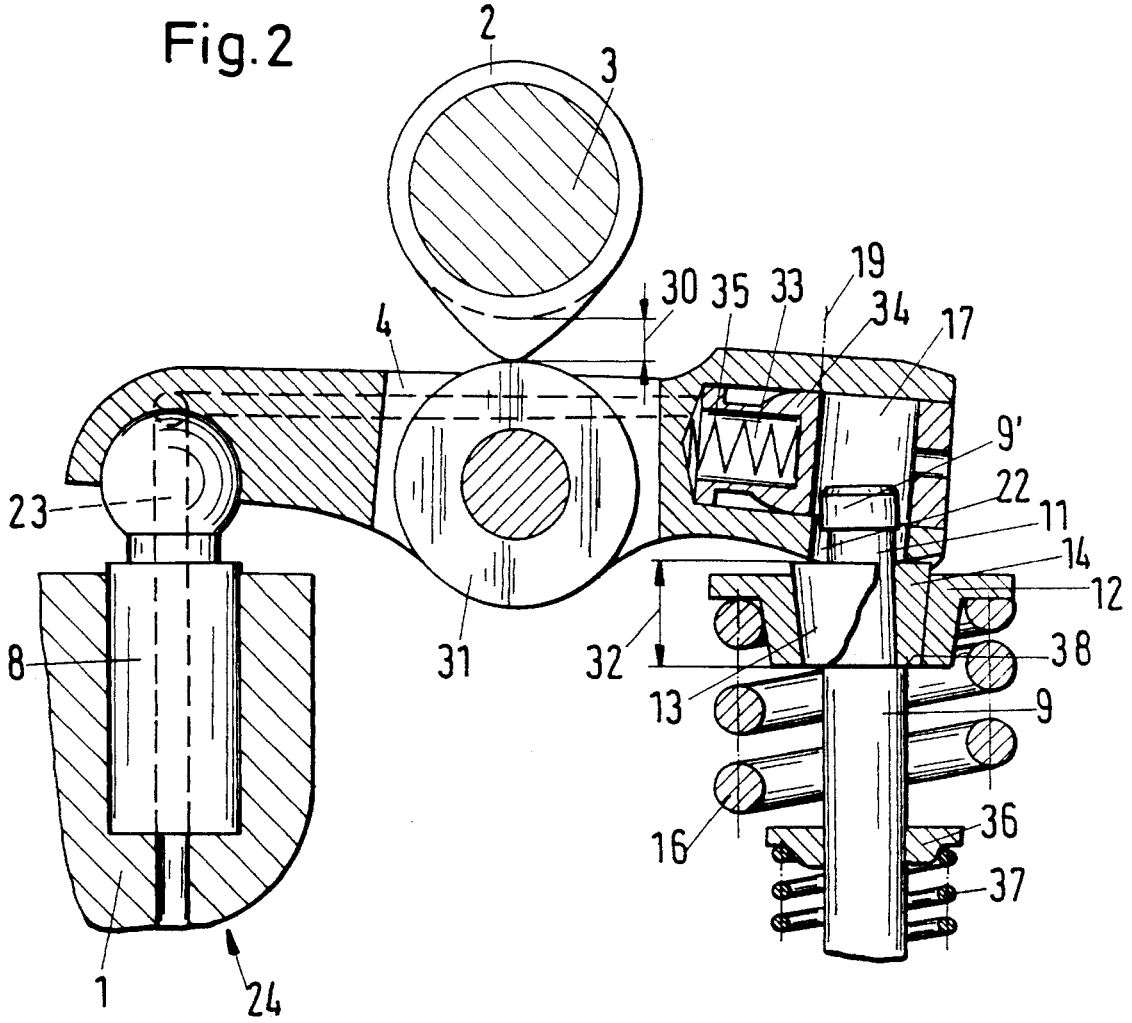
FIG. 2 is a sectional view illustrating another representative embodiment of a valve control arrangement according to the invention having a modified locking element and showing a deactivated valve.

In the modified embodiment of the invention shown in FIG. 2, the locking element 20 constitutes a piston 34 having an axial recess 33. This recess 33 receives a spring 35 which urges the piston 34 toward the first position 18 so as to activate the valve 5. In a manner similar to FIG. 1, the piston 34 can be shifted into the second position 19 by application of a negative pressure to the chamber 17 during the base circle of the cam 2 so that the valve 5 is deactivated.

In both of the embodiments of the invention described above, the axial length of the reduced diameter valve stem section 11 may be made shorter than the sum of the maximum valve lift and the axial height 32 of the spring plate assembly. As a result, when the locking element 20 is in the second position 19 deactivating the valve, there is a slight opening of the valve 5 at the maximum cam lift 30 to prevent accumulation of fuel in the intake duct. To ensure the subsequently required closing motion, an additional spring plate 36 is affixed to the valve stem 9, and an additional spring 37 urges the valve to the closed position. At the maximum cam lift 30 the conical pieces 13 and 14 engage a shoulder at the inner end of the reduced diameter section 11.

Lateral guidance of the roller rocker arm 4 in the cylinder head 1 is obtained by side walls 39 and 40, which laterally engage the spring plate assembly at opposite sides of the opening 22. Corresponding bearing surfaces on the conical pieces 13 and 14 provide lateral guidance of the roller rocker arm 4 as well as preventing rotation of the conical pieces 13 and 14.

Although the invention has been described herein with reference to specific embodiments, many modifications and variations therein will readily occur to those skilled in the art. Accordingly, all such variations and modifications are included within the intended scope of the invention.

I claim:

1. A valve control arrangement for an internal combustion engine comprising a cylinder head having a camshaft and at least one deactivatable valve driven by the camshaft, a coupling element for coupling the valve to the camshaft, a locking element displaceable between a first position connecting the valve in locked relation to the coupling element to activate the valve and a second position permitting relative displacement of the coupling element with respect to the valve to deactivate the valve, a spring plate assembly engaging the coupling element, and a valve-closing spring engaging the spring plate assembly to maintain the coupling element in constant contact with the camshaft.

2. A valve control arrangement according to claim 1 wherein the valve has a valve stem with a reduced diameter section extending in the longitudinal direction of the valve stem which is received in the spring plate assembly with little radial play.

3. A valve control arrangement according to claim 1 wherein the coupling element has a wall engaging the spring plate assembly and having an opening with a diameter greater than that of the valve stem.

4. A valve control arrangement according to claim 2 wherein the axial length of the reduced diameter section is at least as great as the sum of the maximum valve lift and the axial dimension of the spring plate assembly.

5. A valve control arrangement according to claim 2 wherein the axial length of the reduced diameter section is smaller than the sum of the maximum valve lift and the axial height of the spring plate assembly so that in the deactivated condition the valve at maximum cam lift is opened by an amount corresponding to the difference between the sum of the maximum valve lift and the axial height of the spring plate assembly and the length of the reduced diameter section by engagement of the spring plate with a shoulder at one end of the reduced diameter section.

6. A valve control arrangement according to claim 5 including an additional spring plate axially affixed to the valve stem and spaced from the reduced diameter section, and a further spring supported by the cylinder head and engaging the additional spring plate.

7. A valve control arrangement according to claim 3 wherein the locking element is located in a chamber of the coupling element which communicates with the opening and including means for applying pressure to the locking element to move it between a valve-locking and a valve-release position.

8. A valve control arrangement according to claim 7 including a pressure medium duct in the coupling element leading to the chamber and a pressure medium inlet in the cylinder head coupled to the pressure medium duct in a region of little relative movement between the coupling element and the cylinder head.

9. A valve control arrangement according to claim 8 wherein the chamber has a hollow cylindrical shape and has an opening to the atmosphere at the end opposite the pressure medium duct and the locking element is a ball.

10. A valve control arrangement according to claim 8 including a piston displaceable in the chamber by pneumatic pressure and a chamber spring urging the piston from one to the other of the valve-locking and valve-release positions.

11. A valve control arrangement according to claim 8 wherein the coupling element is a rocker arm having a first end supported by a ball cup mounted on a hydraulic play-compensating element in the cylinder head and having a second end in which the chamber is formed and which receives the end of the valve stem.

12. A valve control arrangement according to claim 11 including a bore in the cylinder head to supply pressure medium to the first end of the rocker arm.

13. A valve control arrangement according to claim 2 wherein the spring plate assembly includes a spring plate and two conical pieces and wherein the spring plate is retained on the reduced diameter section by the conical pieces.

14. A valve control arrangement according to claim 9 wherein the spring plate assembly includes a spring plate and two conical pieces and the opening in the chamber facing the spring plate assembly has lateral surfaces which engage corresponding surfaces on the conical pieces.

* * * * *

UNITED STATES PATENT AND TRADEMARK OFFICE

CERTIFICATE OF CORRECTION

PATENT NO. : 5,544,628

DATED : August 13, 1996

INVENTOR(S) : Dieter Voigt

It is certified that error appears in the above-indentified patent and that said Letters Patent is hereby corrected as shown below:

Column 2, line 22, "rocker lever" should read --rocking lever--;

Column 2, line 30, "lever" should read --rocker arm--;

Column 2, line 35, "drag lever" should read --rocker arm--.

Signed and Sealed this

Twenty-seventh Day of May, 1997

*Attest:*

*Attesting Officer*

Bruce Lehman

BRUCE LEHMAN

*Commissioner of Patents and Trademarks*